US012173702B2

(12) United States Patent
Hannah et al.

(10) Patent No.: US 12,173,702 B2
(45) Date of Patent: Dec. 24, 2024

(54) PERISTALTIC PUMP OFFSET ROTOR ASSEMBLY

(71) Applicant: Milton Roy, LLC, Warminster, PA (US)

(72) Inventors: Gary Hannah, Shawnee, KS (US); Bryan Dunn, Louisburg, KS (US)

(73) Assignee: MILTON ROY, LLC, Warminster, PA (US)

( * ) Notice: Subject to any disclaimer, the term of this patent is extended or adjusted under 35 U.S.C. 154(b) by 209 days.

(21) Appl. No.: 17/866,003

(22) Filed: Jul. 15, 2022

(65) Prior Publication Data

US 2024/0018955 A1 Jan. 18, 2024

(51) Int. Cl.
*F04B 43/12* (2006.01)
*F04B 53/22* (2006.01)

(52) U.S. Cl.
CPC ..... *F04B 43/1253* (2013.01); *F04B 43/1276* (2013.01); *F04B 53/22* (2013.01)

(58) Field of Classification Search
CPC ... F04B 43/1253; F04B 43/1276; F04B 53/22
See application file for complete search history.

(56) References Cited

U.S. PATENT DOCUMENTS 1,360,993 A * 11/1920 Hanson ..... F16K 27/0245 251/220
1,848,024 A * 3/1932 Owen ..... F04B 43/1253 417/63
4,184,815 A * 1/1980 Casson ..... F04B 43/1276 604/153
5,215,450 A 6/1993 Tamari
9,103,340 B2 8/2015 Wagner
2005/0196307 A1 9/2005 Limoges
2021/0324845 A1 10/2021 Nguyen et al.

FOREIGN PATENT DOCUMENTS

DE 102009050053 A1 * 5/2011 ..... F04B 43/1276
DE 102017116398 A1 1/2019
EP 1950417 A1 7/2008
EP 2886866 B2 9/2016
WO 2019016279 A1 1/2019

OTHER PUBLICATIONS

European Search Report for EP 23185598.2, dated Jan. 25, 2024, 8 pages.

* cited by examiner

*Primary Examiner* — Nathan C Zollinger
(74) *Attorney, Agent, or Firm* — Edell, Shapiro & Finnan, LLC

(57) ABSTRACT

The disclosed techniques relate to an apparatus including: a pump body, an occlusion bed; and a rotor. The rotor includes: a shaft body; a roller body slidably mounted to the shaft body; and a lock mechanism selectively positioned between a first position and a second position. In the first position, the lock mechanism engages with the roller body to lock the roller body at a first roller body position relative to the shaft body where the one or more rollers can compress tubing disposed in the apparatus against the occlusion bed with a first level of compression. In the second position, the lock mechanism disengages the roller body so the roller body can slide along the track relative to the shaft body to a second roller body position configured to cause decreased or no compression of the tubing against the occlusion bed by the one or more rollers.

20 Claims, 12 Drawing Sheets

PERISTALTIC PUMP OFFSET ROTOR ASSEMBLY

TECHNICAL FIELD

The present disclosure relates to peristaltic pumps.

BACKGROUND

A peristaltic pump is a type of positive displacement pump used for pumping a variety of fluids. The fluid is contained in flexible tubing that is compressed by a rotor. More specifically, the rotor may include a number of rollers attached to its external circumference and these rollers compress the flexible tubing as the rotor rotates. The part of the tubing under compression is closed, forcing the fluid to move through the tubing. As the tubing opens to its natural state after the rollers pass, more fluid is drawn into the tubing. This process is called peristalsis.

Peristaltic pumps may be used in dosing or metering applications. Peristaltic dosing pumps may offer low flow rates, high accuracy, and precise control for repeatable product dosing. When fluid enters a dosing pump, a selected amount of product will enter the pump chamber and disperse one chemical fluid into another such as water to allow the dosing to take place.

DESCRIPTION OF EXAMPLE EMBODIMENTS

Overview

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

In some aspects, the techniques described herein relate to an apparatus including: a pump body, an occlusion bed; and a rotor including: a shaft body configured to engage a shaft which rotates the rotor; a roller body including one or more rollers and a track via which the roller body is slidably mounted to the shaft body; and a lock mechanism selectively positioned between a first position and a second position, wherein, in the first position, the lock mechanism locks the roller body at a first roller body position relative to the shaft body where the one or more rollers can compress tubing disposed in the apparatus against the occlusion bed with a first level of compression, and wherein, in the second position, the lock mechanism disengages the roller body so the roller body can slide along the track relative to the shaft body to a second roller body position configured to cause decreased or no compression of the tubing against the occlusion bed by the one or more rollers.

According to other aspects, the techniques described herein relate to a method, wherein a translation of the roller body along the shaft body so that the rollers no longer compress the tubing against the occlusion bed translates the roller body in a first direction and the method further includes: translating the roller body along the shaft body in a second direction, opposite the first direction, such that the rollers compress the new tubing against the occlusion bed.

Still other aspects of the techniques described herein relate to an apparatus including: a shaft body configured to engage a shaft; a roller body including one or more rollers and a track via which the roller body is slidably mounted to the shaft body; and a lock mechanism selectively positioned between a first position and a second position, wherein, in the first position, the lock mechanism engages the roller body to lock the roller body at a first roller body position relative to the shaft body where the one or more rollers can compress tubing against an occlusion bed with a first level of compression, and wherein, in the second position, the lock mechanism disengages the roller body so the roller body can slide along the track relative to the shaft body to a second roller body position configured to cause decreased or no compression of the tubing against the occlusion bed by the one or more rollers.

Example Embodiments

Figure 1B:
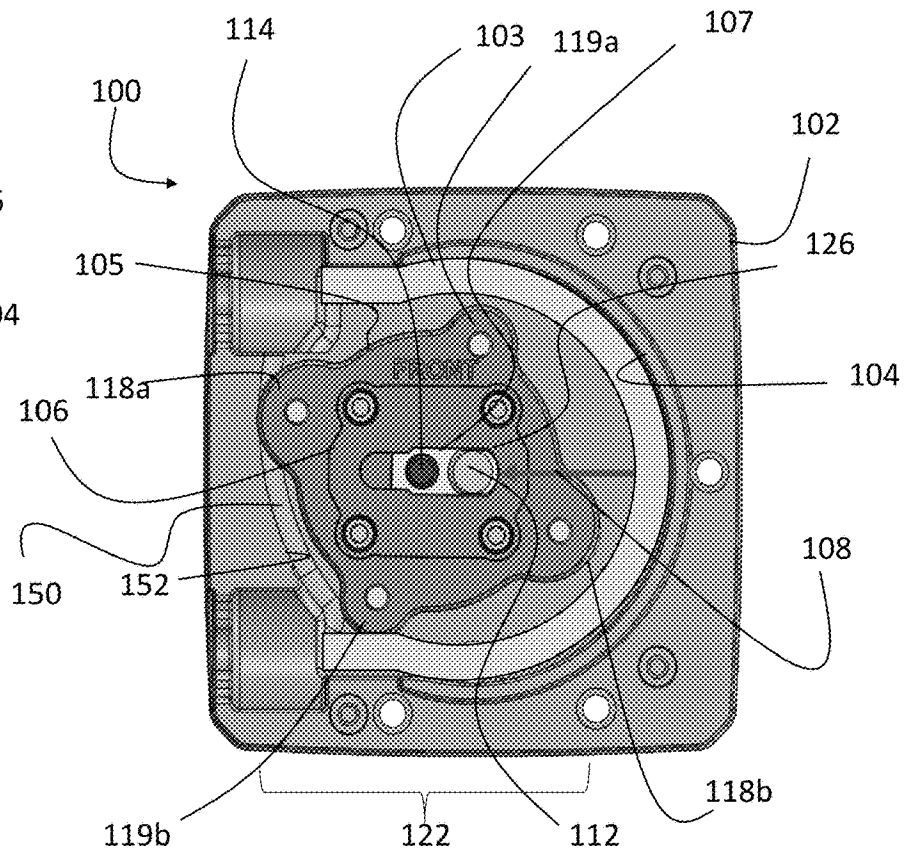
FIG. 1B illustrates the peristaltic pump with the offset rotor assembly in an offset position, according to an example embodiment.
Figure 1A:
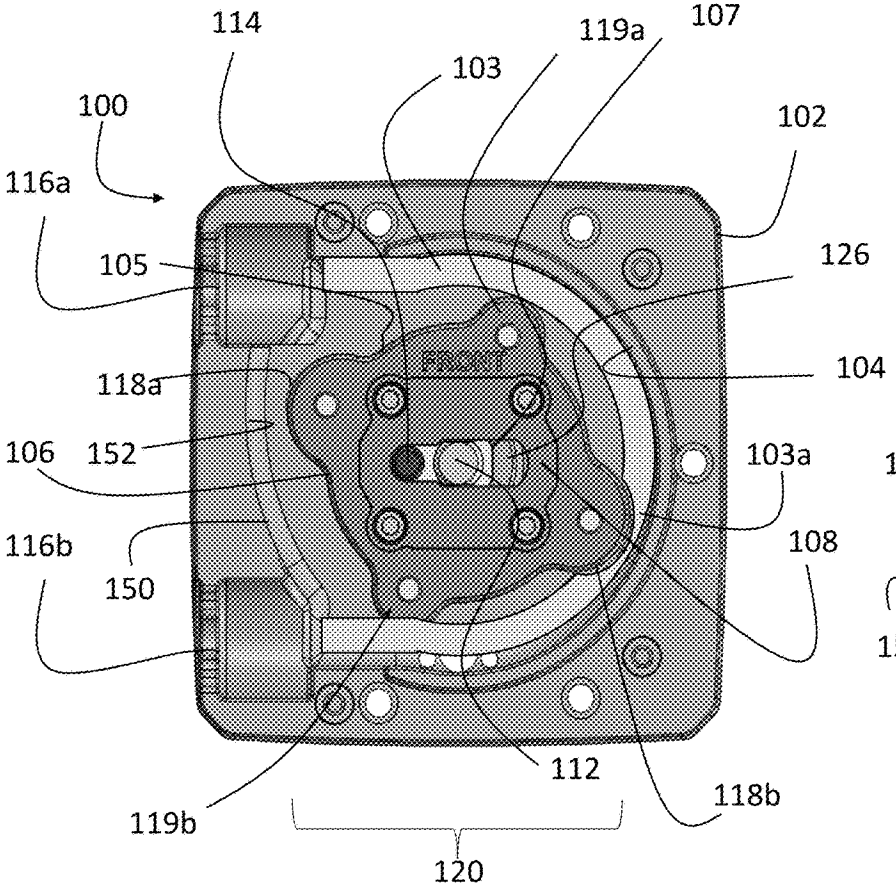
FIG. 1A illustrates a peristaltic pump with an offset rotor assembly in an operating position, according to an example embodiment.

With reference now made to FIGS. 1A and 1B, depicted therein in is a pump body 102 of a peristaltic pump 100 constructed according to an example embodiment of the disclosed techniques. Peristaltic pumps, also known as roller pumps, are a type of positive displacement pump. Generally, a peristaltic pump includes flexible tubing in which the fluid to be pumped is contained, and a rotor with rollers. The rollers compress the flexible tubing as they rotate. The part of the tubing under compression is closed due to the compression, forcing the fluid to move through the tubing. As the tubing opens to its natural state after the rollers pass, more fluid is drawn into the tubing. This process is called peristalsis, the process from which this type of pump derives its name. Peristaltic pumps may be used to provide repeatable and accurate dosing and metering of fluids and suspended solids for applications that include:

- Medical device applications;
- Analytical chemistry applications, such as the harvesting of cell media;
- Pharmaceutical production applications;
- Beverage supply equipment applications;
- Food manufacturing applications;
- Chemical handling applications;
- Water and wastewater handling applications;
- Engineering and manufacturing applications; and others known to the skilled artisan.

The techniques disclosed herein may be applied to all types of peristaltic pumps, though peristaltic pump 100 is illustrated as a dosing pump.

As described in detail below, peristaltic pump 100 includes a pump rotor 105 (including rollers 118*a*, 118*b*, 119*a* and 119*b*) with an integrated slide mechanism that allows for radial movement of the rotor 105, offsetting the rotor from a centralized pumping position 120. The rotor assembly slide mechanism may lock into a central pumping position unless the release is activated. By activating the release, the rotor may slide to the offset position 122 in which the tubing 103 undergoes less compression, including no compression by the rollers in certain embodiments. As explained in detail below, the offset rotor position 122 allows a simpler, quicker, safer placement or exchange of the tubing 103. For example, because the rotor 105 is offset such that the tubing 103 undergoes decreased compression, existing tubing may be more easily removed and new tubing may be more easily placed within the peristaltic pump 100. Generally, the removal of old tubing and the placement of new tubing requires the user to elongate the tubing so that it can be more easily removed from or placed into the area between the rollers and the occlusion bed. Offsetting the rotor and accompanying rollers from the occlusion bed may eliminate this need to elongate the tubing.

As illustrated, pump body 102 includes an occlusion bed 104. When in operation, tubing 103 is fed through tube collar 116*a*, along occlusion bed 104, and through tube collar 116*b*. The rotation of rotor 105 via shaft 112 causes main rollers 118*a* and 118*b* to compress tubing 103 against occlusion bed 104, as illustrated in compressed region 103*a* of FIG. 1A. This compression of tubing 103 pumps the fluid in tubing 103 in the direction of the rotation of rotor 105. Guide rollers 119*a* and 119*b* ensure correct seating of tubing 103 during compression by the main rollers 118*a* and 118*b*.

The maintenance of peristaltic pumps includes replacing worn or used tubing with new tube assemblies. This replacement process may take place after a single use or a few times a year, though longer or shorter intervals may be used depending on tube material and pump operating parameters. Tubing replacement may be a cumbersome process in which a user manually elongates the old tubing to remove it from the pump body. The tubing is elongated due to the interference between the old tubing, main rollers 118*a* and 118*b*, and occlusion bed 104, as illustrated in compressed region 103*a* in FIG. 1A. Certain conventional peristaltic pumps may be configured to perform tube replacement while the rotor rotates, such as rotating at approximately 6 rotations per minutes (RPMs). The rotation of the rotor during tube replacement may present safety issues. For example, an operator's fingers may be compressed between the rollers 118*a*, 118*b*, 119*a* and 119*b* and the occlusion bed 104. Other techniques, such as maintenance processes that include removal of the rotor, may be inconvenient, requiring tooling to remove or reposition the rotor during tubing replacement. The techniques of the present disclosure may address these issues in related art peristaltic pumps.

As illustrated in FIGS. 1A and 1B, roller body 106 of rotor 105 is configured to translate from a first position 120, illustrated in FIG. 1A, to a second offset position 122 (also referred to as an offset position 122 or variations thereof), illustrated in FIG. 1B. First position 120 places main rollers 118*a* and 118*b* in relatively close proximity to occlusion bed 104, placing rotor 105 in an operating position such that main rollers 118*a* and 118*b* compress tubing 103 against occlusion bed 104, as illustrated by compressed tubing region 103*a* of FIG. 1A. Second position 122, on the other hand, offsets roller body 106 such that main rollers 118*a* and 118*b* are positioned further from occlusion bed 104 (as compared to the first position 120), as illustrated through the absence of a compressed portion in tubing 103 of FIG. 1B. This offset position 122 of roller body 106 allows for the placement and removal of tubing 103 without, for example, requiring elongation of the tubing 103. Furthermore, because main rollers 118*a* and 118*b* are positioned further from occlusion bed 104, an operator may safely replace the tubing 103 with less chance of the operator's fingers being caught between rollers 118*a*, 118*b*, 119*a* and 119*b* and occlusion bed 104.

During pumping operation of peristaltic pump 100, shaft 112 drives the rotation of rotor 105. Specifically, shaft 112 is coupled to shaft body 107 such that the rotation of shaft 112 also rotates shaft body 107. In some instances, shaft 112 may be the shaft of a motor included in or coupled to the peristaltic pump 100. However, in other instances, the shaft 112 may be or comprise a linkage, coupler, or any other mechanical component configured to operably couple the shaft body 107 to a motor or any other component configured to impart rotational force to the shaft 112. In any case, since roller body 106 is in position 120 during operation, the tubing 103 will be compressed against occlusion bed 104, as illustrated in FIG. 1A. A locking mechanism that includes actuator 114 (e.g., a button) and described in detail below, ensures that roller body 106 remains in operating position 120.

During maintenance, on the other hand, an operator may unlock roller body 106 by pressing actuator 114 which disengages the locking mechanism, allowing roller body 106 to translate from position 120 of FIG. 1A to position 122 of FIG. 1B. Once roller body 106 is arranged at position 122, tubing 103 may be more easily removed without, for example, it being elongated to remove it from being compressed between rollers 118*a* and 118*b* and occlusion bed 104. Similarly, replacement tubing may be installed without it being elongated to fit between rollers 118*a* and 118*b* and occlusion bed 104.

Roller body 106 is also configured such that roller body 106 automatically translates back to position 120 from position 122 when maintenance is completed and rotation of roller body 106 is restarted. Included in pump body 102 is ramp 150. Ramp 150 provides a surface 152 against which rollers 118*a* and 118*b* roll when in position 122. As illustrated in FIGS. 1A and 1B, the distance between surface 152 and shaft 112 decreases in a counter-clockwise direction—meaning surface 152 is further from shaft 112 in the vicinity of tube collar 116*a* and closer to shaft 112 in the vicinity of tube collar 116*b*. Accordingly, as roller body 106 rotates about shaft 112 in position 122, one of rollers 118*a* or 118*b* will engage with surface 152 of ramp 150. Beginning in position 122, as the roller 118*a*/118*b* rotates through a position in the vicinity of tube collar 116*a* to a position in the vicinity of tube collar 116*b*, the engagement between the roller 118*a*/118*b* and the surface 152 of ramp 150 drives roller body 106 such that it translates along shaft 112 via elongated orifice 126 from position 122 of FIG. 1B to position 120 of FIG. 1A. Once arranged back in position 120, roller body 106 will be locked in position, as described with reference to FIGS. 2A-2C below.

Figure 2A:
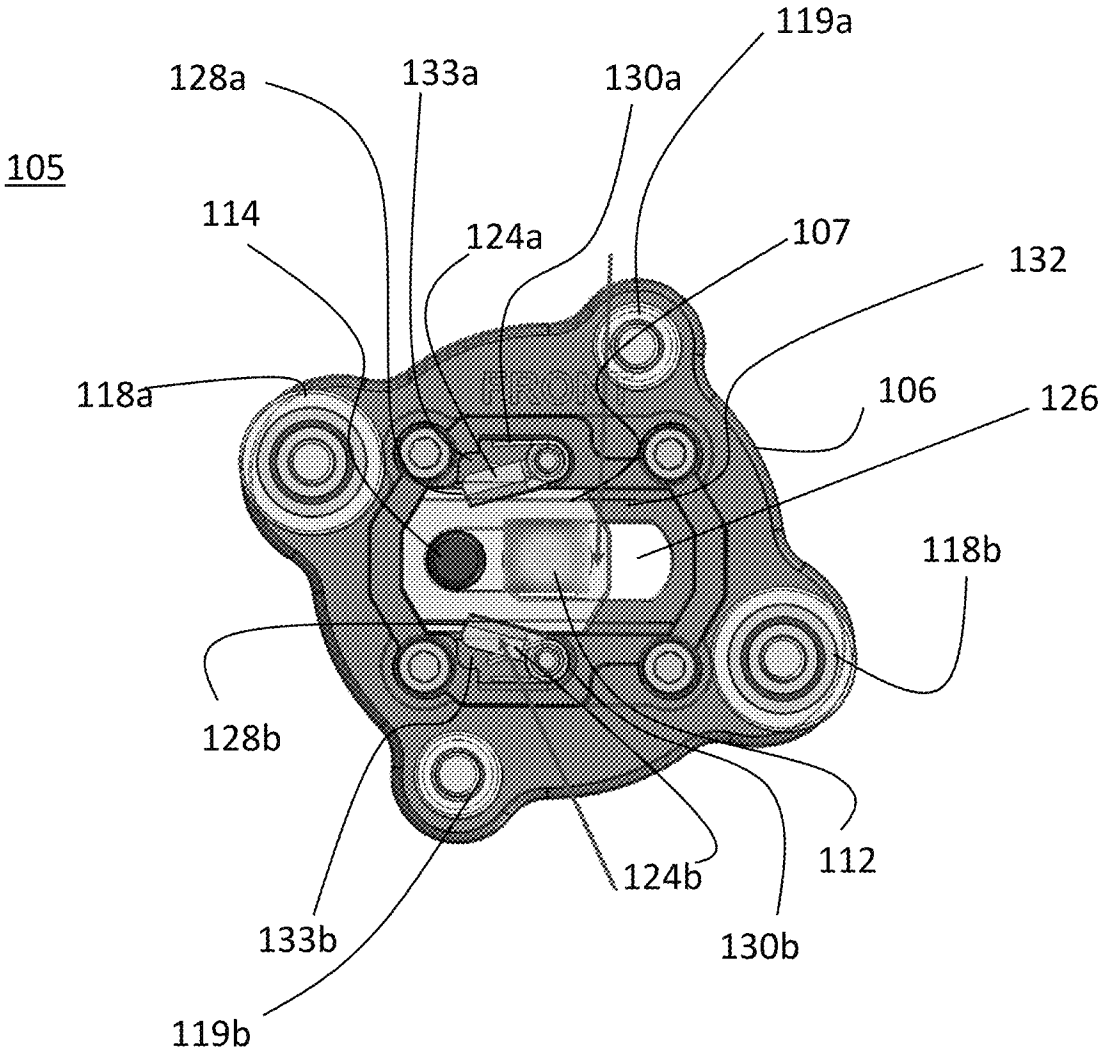
FIG. 2A illustrates an offset rotor assembly utilizing a first locking mechanism in a locked operating position, according to an example embodiment.
Figure 2B:
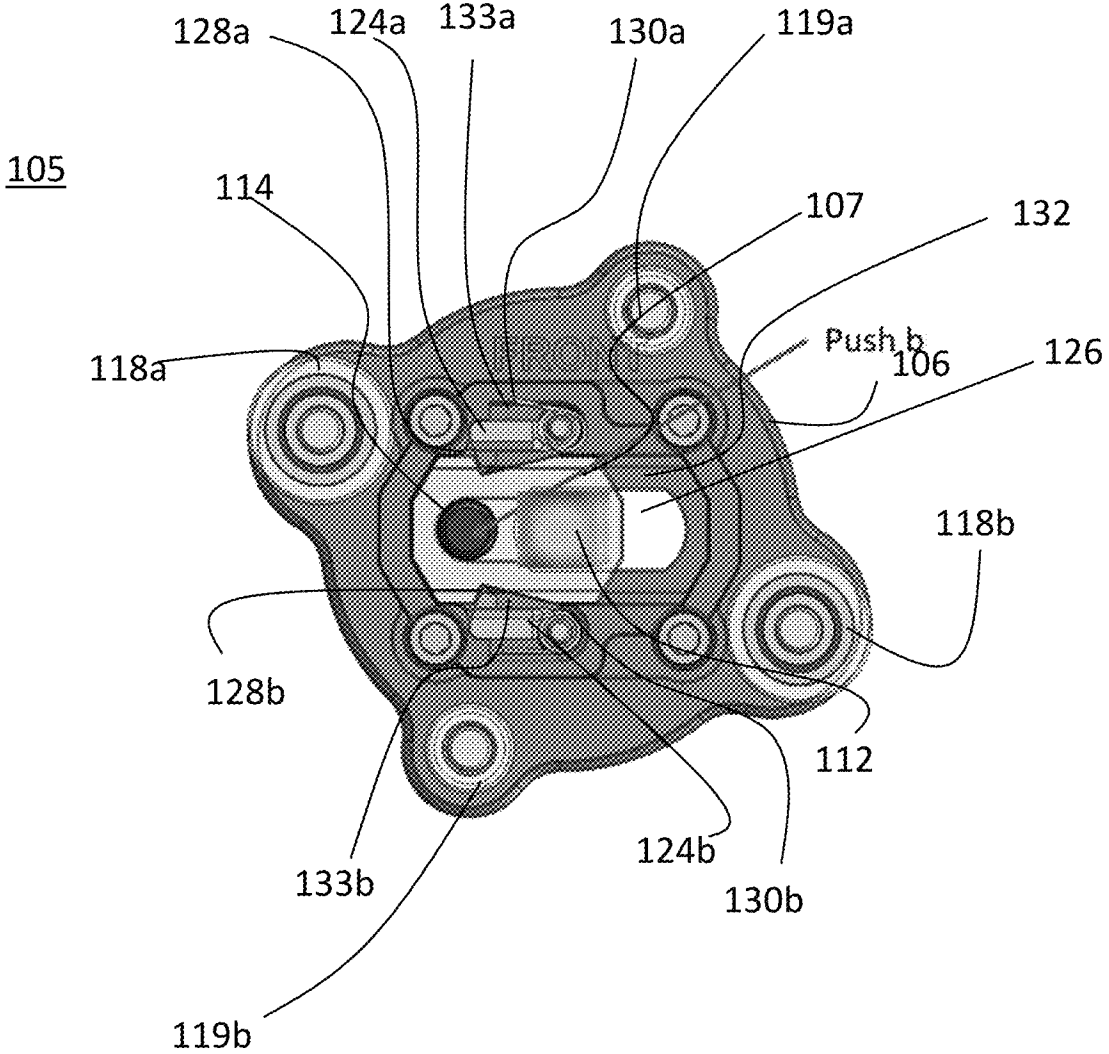
FIG. 2B illustrates the offset rotor assembly utilizing the first locking mechanism in an unlocked operating position, according to an example embodiment.
Figure 2C:
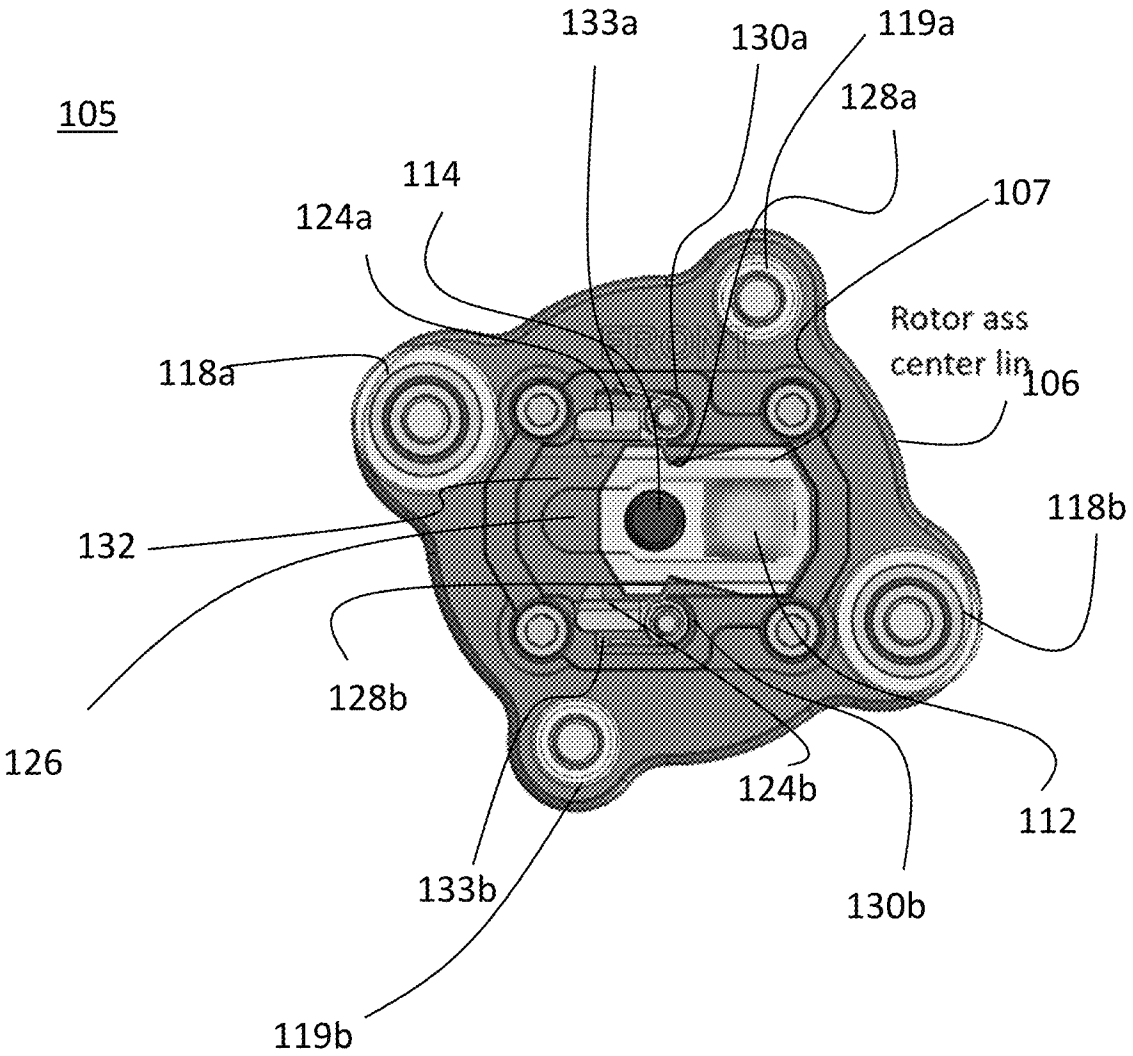
FIG. 2C illustrates the offset rotor assembly utilizing the first locking mechanism in an offset position, according to an example embodiment.

Turning to FIGS. 2A-2C, depicted therein are a series of images illustrating the translation of the roller body 106 of rotor 105 from a first position, in which the rotor 105 is configured to pump, and a second offset position in which roller body 106 and main rollers 118*a* and 118*b* are positioned further from the occlusion bed of the peristaltic pump. FIGS. 2A-2C also illustrate the components of a first example locking mechanism that ensures roller body 106 remains in position 120 (illustrated in FIG. 1A) when operating and the disengagement of which allows roller body 106 to translate to position 122 (illustrated in FIG. 1B) for maintenance. Specifically, FIGS. 2A-2C illustrate roller body 106 with cover 108 removed so that shaft body 107 and the components of the locking mechanism are visible. In the embodiment of FIGS. 2A-2C, the locking mechanism includes an actuator 114, lever locks 124*a* and 124*b*, biasing members 130*a-c* (see also FIG. 3), such as torsion springs, and notches 128*a* and 128*b* of shaft body 107.

When rotor 105 is in an operating position (corresponding to position 120 of FIG. 1A), lever locks 124*a* and 124*b* (arranged within depressions 133*a* and 133*b* of roller body 106) engage with notches 128*a* and 128*b* in shaft body 107, respectively. To ensure that lever locks 124*a* and 124*b* remain engaged with notches 128*a* and 128*b*, biasing members 130*a* and 130*b* (as well as biasing members 130*c* and 130*d* illustrated in FIG. 3) induce a torque against lever locks 124*a* and 124*b*, pressing them into notches 128*a* and 128*b* regardless of the orientation of rotor 105 as it rotates during pump operation. The engagement of lever locks 124*a* and 124*b* with notches 128*a* and 128*b* locks roller body 106 in the pumping position by preventing roller body from moving relative to shaft body 107.

As illustrated in FIG. 2A, the external shape of shaft body is generally or substantially hexagonal, as is the internal shape of the track 132. Accordingly, shaft body 107 can drive the rotation of roller body 106 much the same way that a hexagonal driver may drive a hexagonal socket. As will now be described with reference to FIG. 2B, when actuator 114 is actuated (e.g., pressed), lever locks 124*a* and 124*b* rotate so that they no longer engage with notches 128*a* and 128*b*, and roller body 106 may be offset along track 132 relative to shaft body 107.

Turning to FIG. 2B, depicted therein is the result of actuating actuator 114. When actuator 114 is actuated, lever locks 124*a* and 124*b* are rotated within depressions 133*a* and 133*b* so that lever locks 124*a* and 124*b* no longer engage with notches 128*a* and 128*b*. With lever locks 124*a* and 124*b* disengaged from notches 128*a* and 128*b*, roller body 106 can slide along track 132 from the operating position of FIGS. 2A and 2B (corresponding to position 120 of FIG. 1A) to the offset position illustrated in FIG. 2C in which rollers 118*a* and 118*b* are arranged further from the occlusion bed 104 (corresponding to position 122 of FIG. 1B).

To facilitate the translation illustrated in FIG. 2C, roller body 106 includes orifice 126 and track 132. Orifice 126 is provided with an elongated shape which allows shaft 112 to engage with shaft body 107 throughout the entire range of motion of roller body 106. The specific elongated shape of orifice 126 illustrated in FIG. 2C is that of a stadium, i.e., a two-dimensional geometric shape constructed of a rectangle with semicircles at a pair of opposite sides. The rectangular portion of orifice 126 generally corresponds to the length of translation that roller body 106 makes relative to shaft body 107 along track 132. Orifice 126 may be embodied with another elongated shaped, such as a rectangle, particularly if shaft 112 is provided with a square or other polygonal cross-section.

The interior shape of track 132 is configured to substantially match the exterior of shaft body 107, but being more elongated. Accordingly, roller body 106 is able to translate relative to shaft body 107 due to the elongation of track 132 relative to shaft body 107. As noted above, both track 132 and the exterior of shaft body 107 are generally hexagonal in shape. This hexagonal shape facilitates the rotation of roller body 106 by shaft body 107 when in the locked position.

When actuator 114 is released, roller body 106 will automatically return to the position illustrated in FIG. 2A. Specifically as described above with reference to FIGS. 1A and 1B, one of rollers 118*a* or 118*b* will engage with surface 152 of ramp 150 formed in pump body 102, forcing pump body from position 122 of FIG. 1B to position 120 of FIG. 1A. Once back in position 120, lever locks 124*a* and 124*b* reengage with notches 128*a* and 128*b*, locking roller body 106 in place, as illustrated in FIGS. 1A and 2A. Furthermore, when roller body 106 automatically returns to position 120, it will elongate tubing 103 so that it is recessed in the occlusion bed 104.

Figure 3:
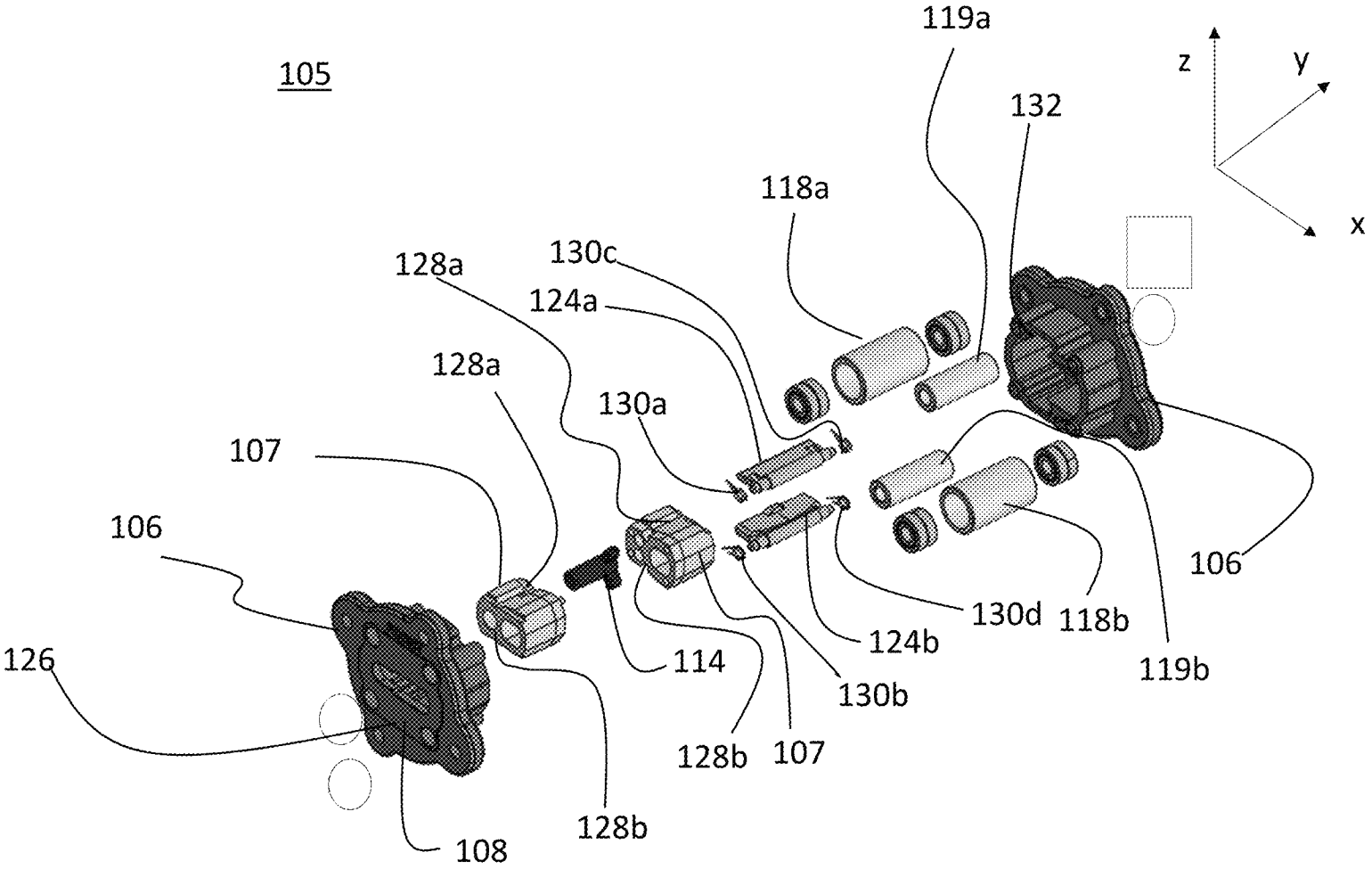
FIG. 3 illustrates an exploded view of the offset rotor assembly utilizing the first locking mechanism, according to an example embodiment.

With reference now made to FIG. 3, depicted therein is an exploded view diagram of rotor 105 in which roller body 106 and shaft body 107 are shown split into two pieces to show the internal structure of actuator 114 and lever locks 124*a* and 124*b*, as well as a full view of track 132. As shown, shaft body 107 fits within track 132. As discussed above, the external shape of shaft body 107 is generally hexagonal, as is the internal shape of the track 132. Accordingly, shaft body 107 can drive the rotation of roller body 106 much the same way that a hexagonal driver may drive a hexagonal socket. As also discussed above, the external shape of shaft body 107 is shorter than the internal shape of track 132 in the y-direction of FIG. 3. This difference in length in the y-direction allows roller body 106 to translate about shaft body 107 in the y-direction when lever locks 124*a* and 124*b* are in the unlocked position.

Figure 4A:
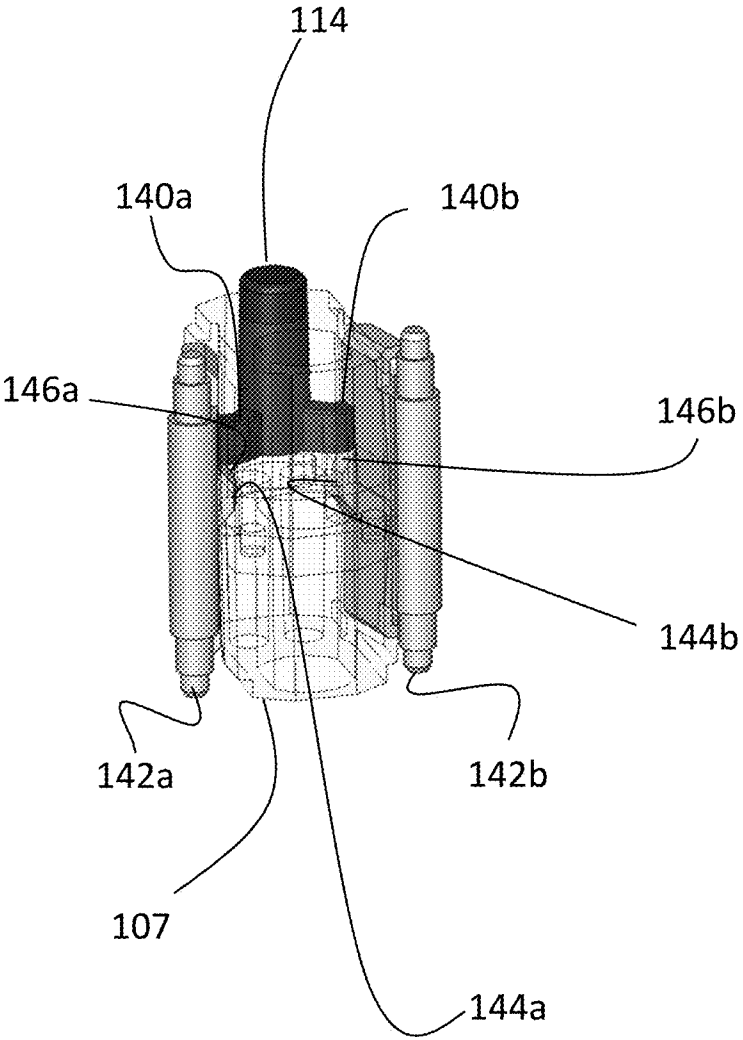
FIG. 4A illustrates the first locking mechanism in a perspective view, according to an example embodiment.
Figure 4C:
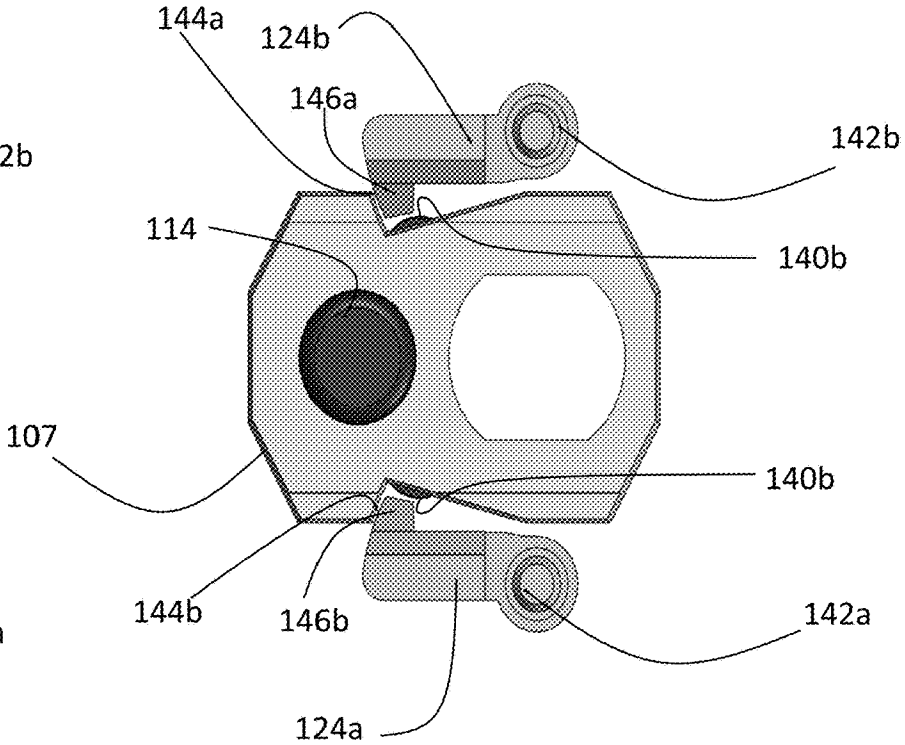
FIG. 4C illustrates the first locking mechanism in an unlocked position in a plan view, according to an example embodiment.
Figure 4B:
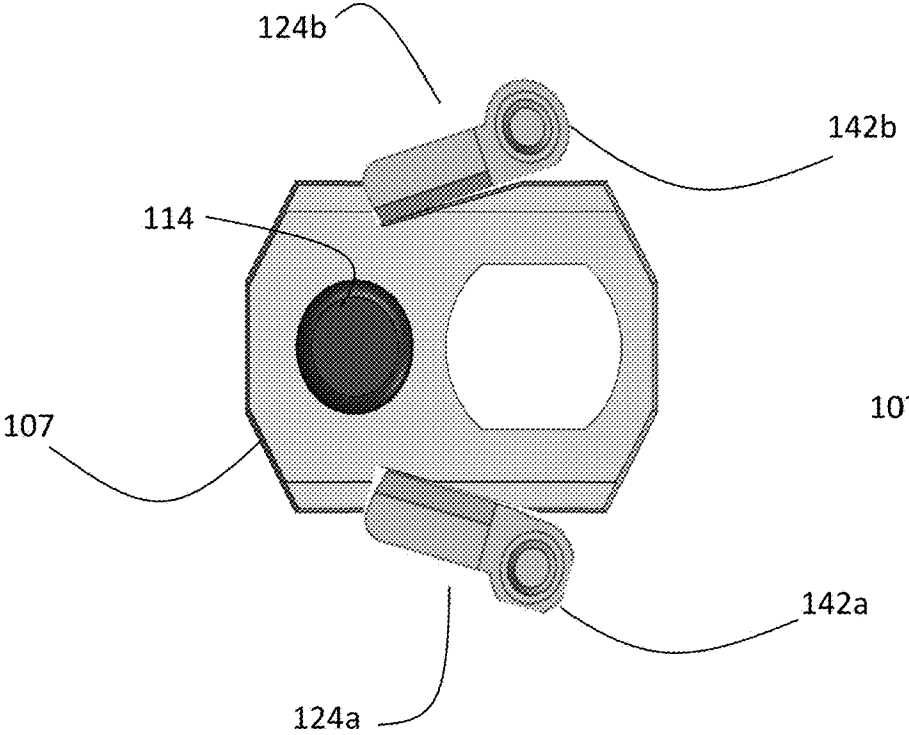
FIG. 4B illustrates the first locking mechanism in a locked position in a plan view, according to an example embodiment.
Figure 4E:
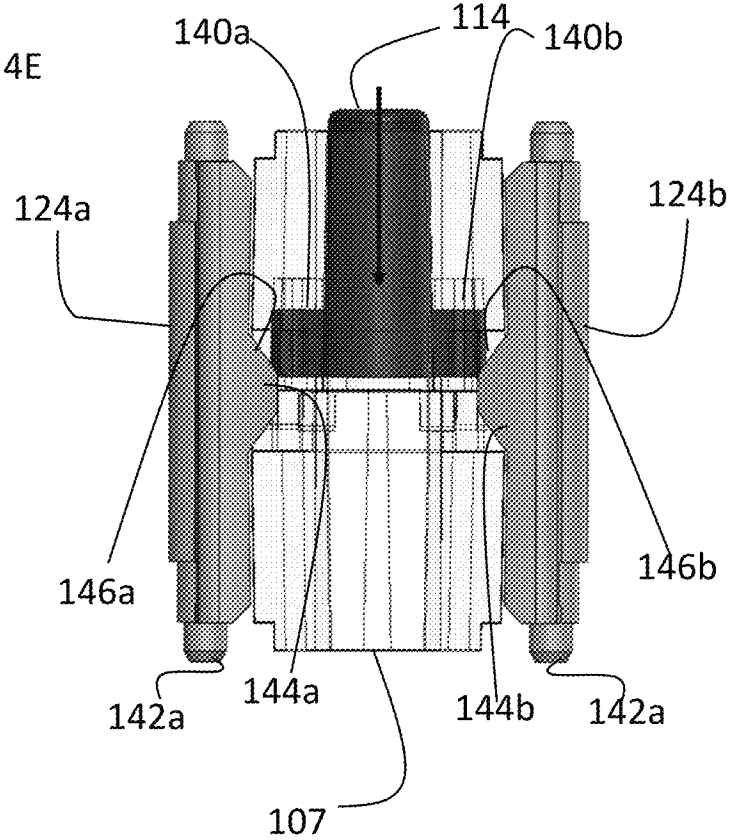
FIG. 4E illustrates the first locking mechanism in an unlocked position in an elevation view, according to an example embodiment.
Figure 4D:
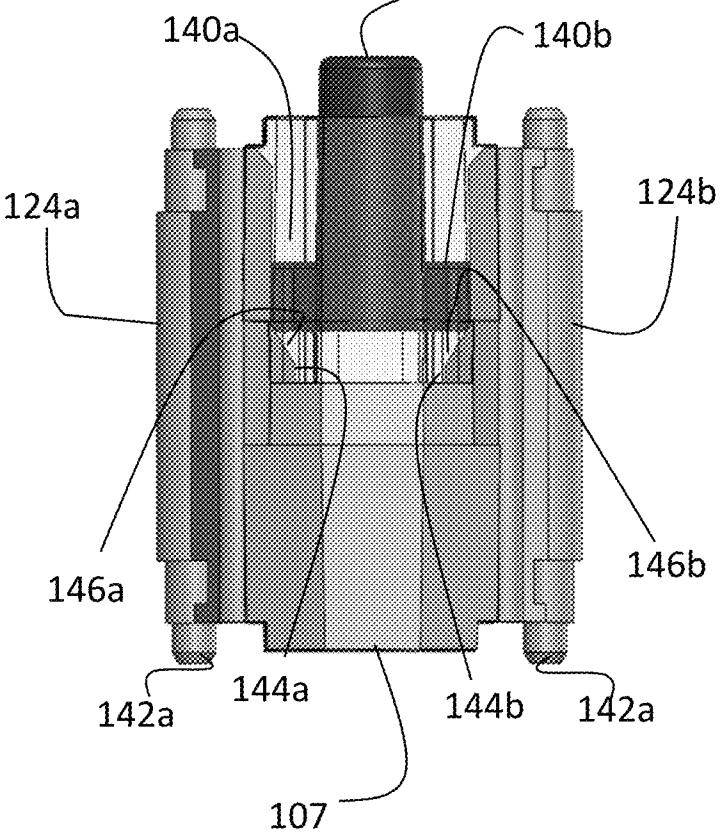
FIG. 4D illustrates the first locking mechanism in a locked position in an elevation view, according to an example embodiment.

Turning to FIGS. 4A-E, illustrated therein is the operation of actuator 114 and lever locks 124*a* and 124*b*. FIG. 4A presents a perspective view of actuator 114 and lever locks 124*a* and 124*b*, FIGS. 4B and 4C illustrate actuator 114 and lever locks 124*a* and 124*b* from the x-z plane of FIG. 3 when actuator 114 is not engaged and when it is engaged, respectively. FIGS. 4D and 4E illustrate actuator 114 and lever locks 124*a* and 124*b* from the y-z plane of FIG. 3 when actuator 114 is not engaged and when it is engaged, respectively. As illustrated in FIGS. 4A-E, actuator 114 includes feet 140*a* and 140*b*, while lever locks 124*a* and 124*b* include rotation axes 142*a* and 142*b* and protrusions 144*a* and 144*b*, respectively. Protrusions 144*a* and 144*b* include angled surfaces 146*a* and 146*b*, respectively.

As illustrated in FIGS. 4B-4E, when actuator 114 is actuated (e.g., by a user, a robotic actuation, etc.), feet 140*a* and 140*b* engage with angled surfaces 146*a* and 146*b* of protrusions 144*a* and 144*b*, respectively. As feet 140*a* and 140*b* travel along angled surfaces 146*a* and 146*b*, lever locks 124*a* and 124*b* rotate about axes 142*a* and 142*b*, respectively. As illustrated in FIG. 4C, this rotation causes lever locks 124*a* and 124*b* to disengage from notches 128*a* and 128*b* of roller body 106. When actuator 114 is released, biasing members 130*a-c* (illustrated in FIGS. 2A-2C and 3) will force actuator 114 and lever locks 124*a* and 124*b* to return to the positions illustrated in FIGS. 4B and 4D from the positions illustrated in FIGS. 4C and 4E. Specifically, biasing members 130*a-c* apply a torque to lever locks 124*a* and 124*b* such that they rotate in the direction opposite that caused by actuating (e.g., pressing) the actuator 114 (e.g., a button). The lever locks 124*a* and 124*b* will, in turn drive feet 140*a* and 140*b* of actuator 114 upwards along angled surfaces 146*a* and 146*b*, returning actuator 114 to the position illustrated in FIGS. 4A, 4B and 4D. Furthermore, as described above, the rotation of roller body 106 after maintenance is completed will drive roller body 106 from the position illustrated in FIG. 2C back to the position illustrated in FIG. 2B. This translation back results in the locking of roller body 106 relative to shaft body 107 via the engagement of lever locks 124*a* and 124*b* with notches 128*a* and 128*b*, respectively, as illustrated in FIG. 2A.

Figure 5A:
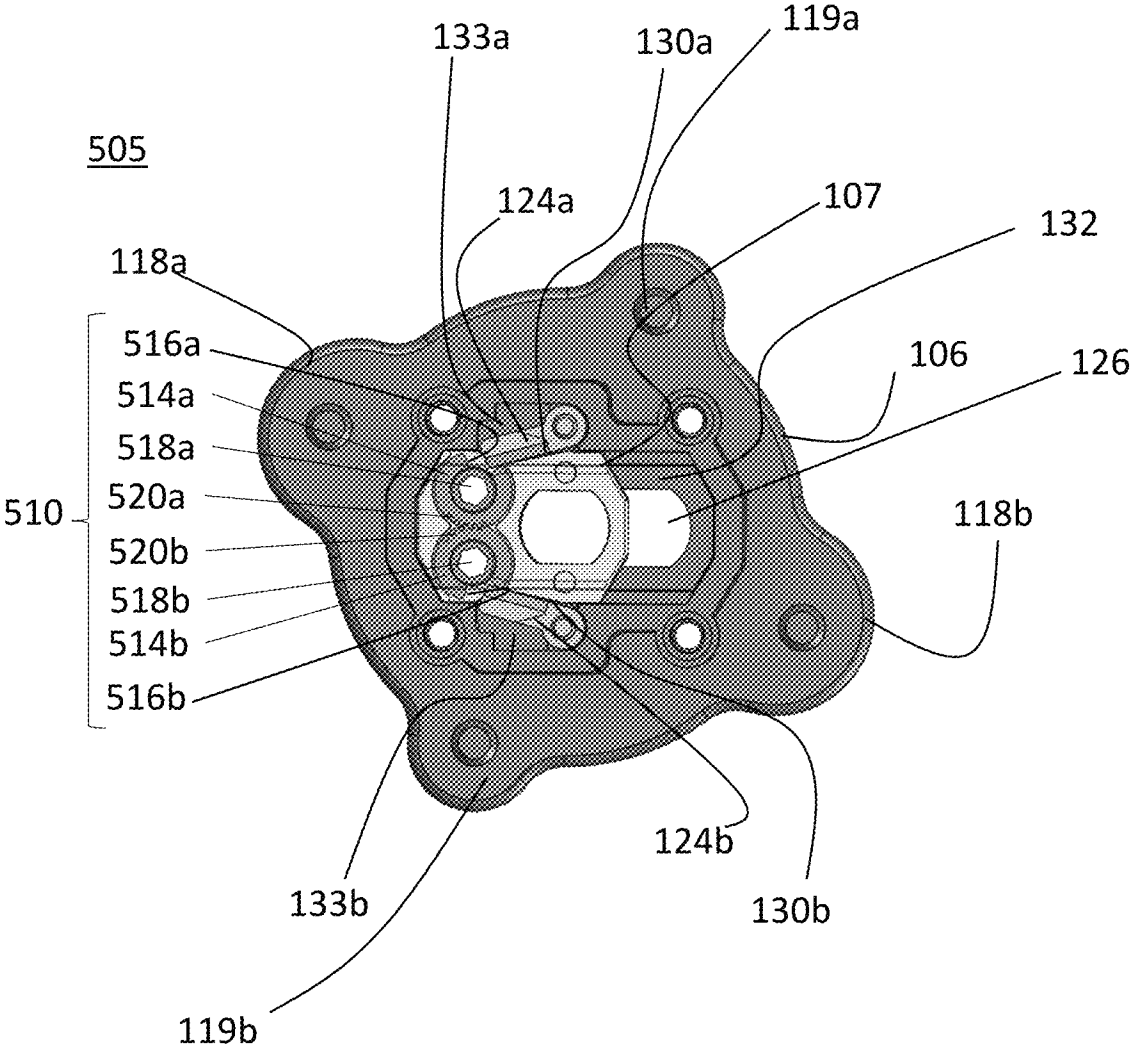
FIG. 5A illustrates an offset rotor assembly utilizing a second locking mechanism in a locked operating position, according to an example embodiment.
Figure 5B:
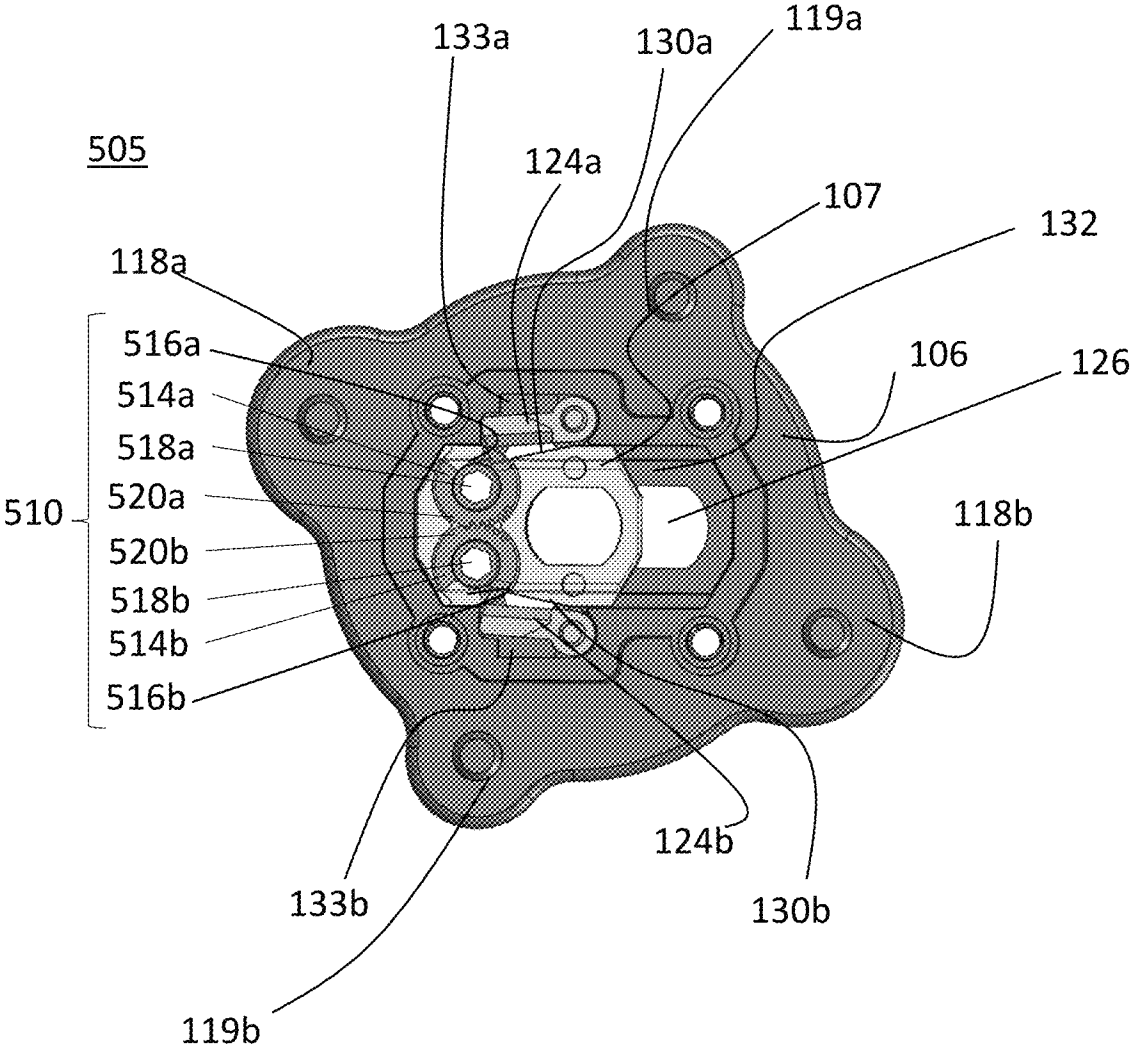
FIG. 5B illustrates the offset rotor assembly utilizing the second locking mechanism in an unlocked operating position, according to an example embodiment.
Figure 5C:
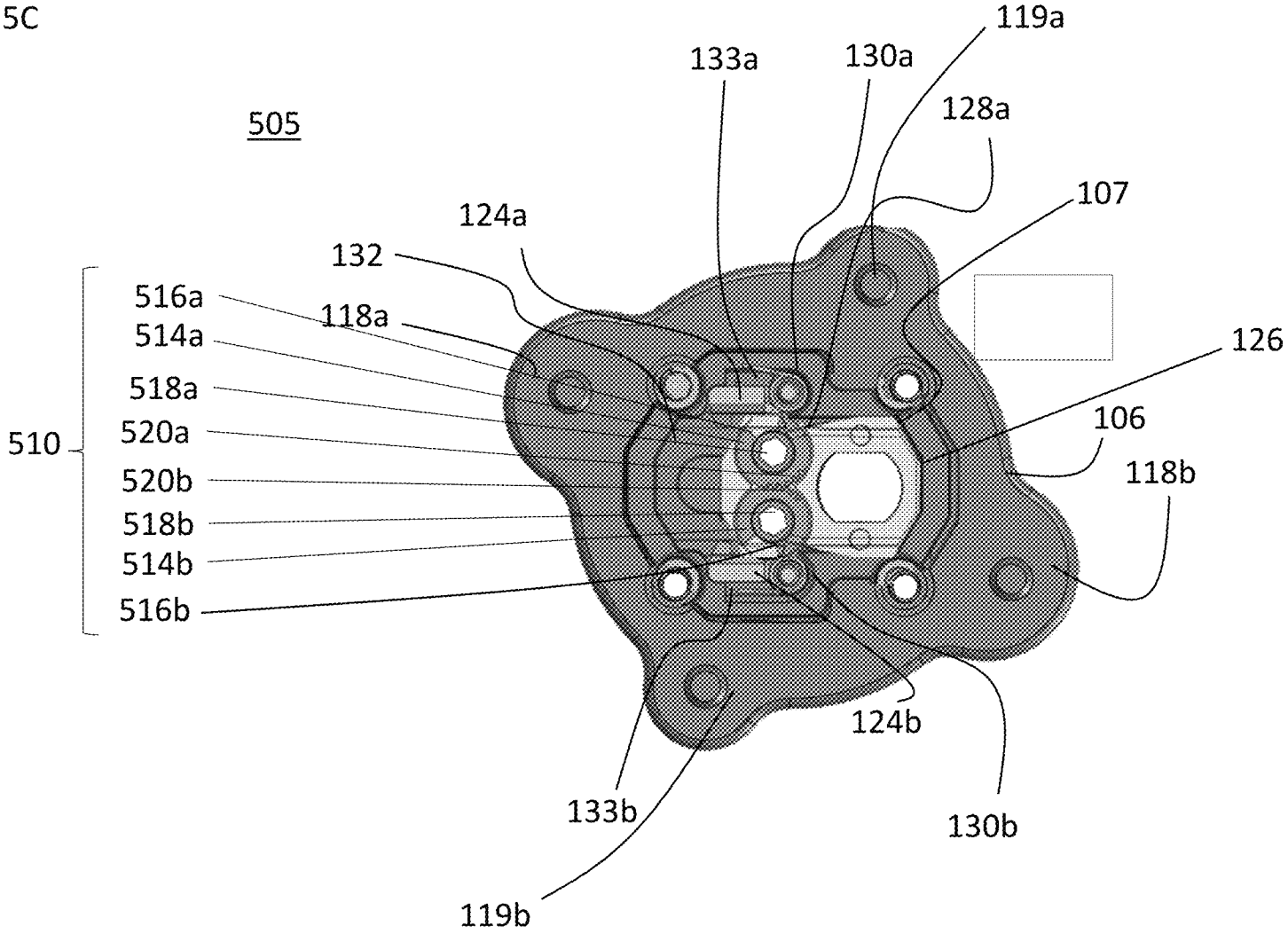
FIG. 5C illustrates the offset rotor assembly utilizing the second locking mechanism in an offset position, according to an example embodiment.

With reference now made to FIGS. 5A-5C, depicted therein a peristaltic pump rotor 505 that embodies a second example embodiment of the disclosed techniques. Specifically, the example of FIGS. 5A-5C replaces the actuator-based locking mechanism of FIGS. 1A, 1B, 2A-2C, 3 and 4A-4E with gear system 510. Gear system 510 includes gears 514*a* and 514*b*, notches 516*a* and 516*b*, and hexagonal sockets 518*a* and 518*b* which facilitate the locking and unlocking of roller body 106.

When in the operating position (i.e., when roller body 106 is positioned closer to the occlusion bed corresponding to position 120 of FIG. 1A), lever locks 124*a* and 124*b* are arranged to engage with notches 516*a* and 516*b* of gears 514*a* and 514*b*, respectively. This engagement between lever locks 124*a* and 124*b* with notches 516*a* and 516*b* secures roller body 106 in the operating position relative to shaft body 107. When gears 514*a* and 514*b* are rotated from the position illustrated in FIG. 5A to the position in FIG. 5B, lever locks 124*a* and 124*b* are pushed outwards from notches 516*a* and 516*b* by the rotation of gears 514*a* and 514*b*, unlocking roller body 106 from shaft body 107. Specifically, if gear 514*a* is rotated clockwise by, for example, engaging a hexagonal driver with hexagonal socket 518*b*, both of gears 514*a* and 514*b* will rotate due to the engagement of teeth 520*a* of gear 514*a* with teeth 520*b* of gear 514*b*, resulting in the unlocking of roller body 106. Similarly, rotating gear 514*b* counterclockwise will rotate both of gears 514*a* and 514*b*, also resulting in the unlocking of roller body 106. Once unlocked, roller body 106 can be moved from the location relative to shaft body 107 illustrated in FIGS. 5A and 5B to the location illustrated in FIG. 5C.

As with the examples of FIGS. 1A, 1B, 2A-2C, 3 and 4A-4E, once the rotor 105 is positioned as illustrated in FIG. 5C, tubing may be removed and replaced within a peristaltic pump without needing to be elongated. Accordingly, a rotor constructed as illustrated in FIGS. 5A-5C may facilitated simpler, easier, and safer tubing replacement.

Figure 6:
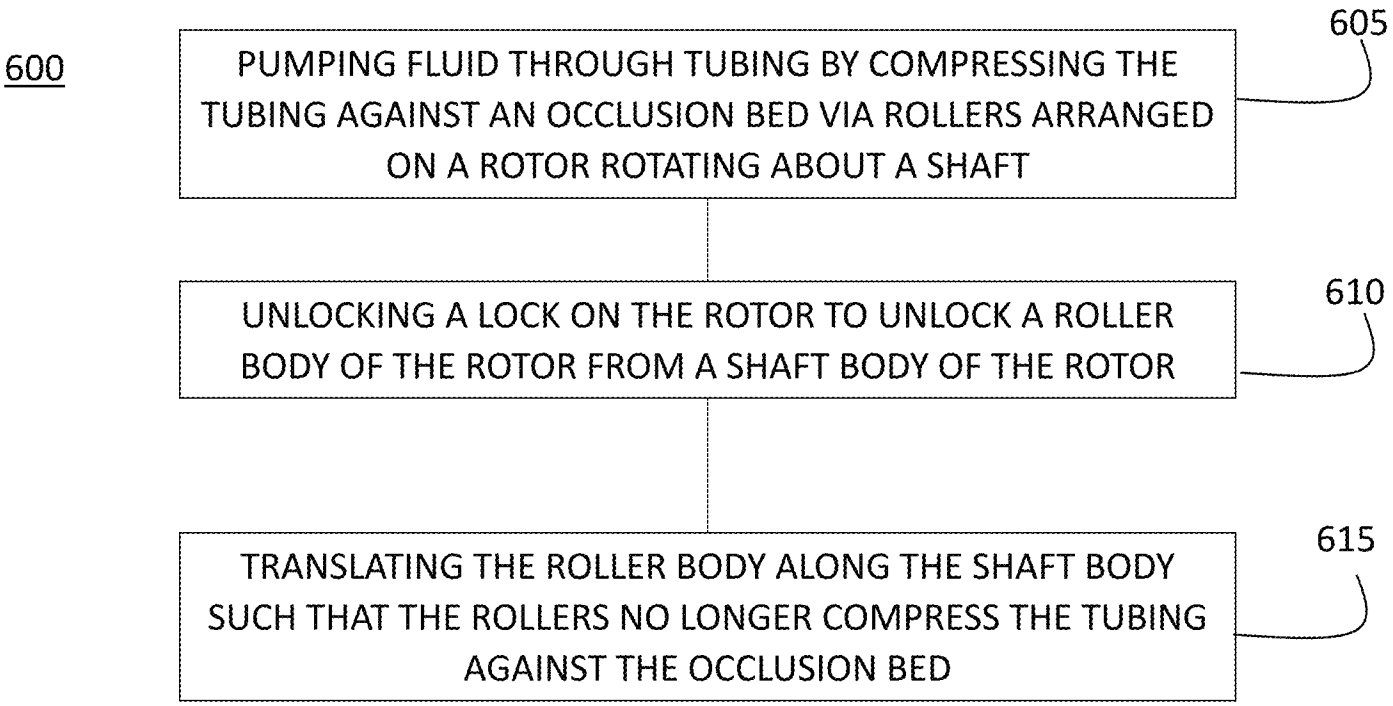
FIG. 6 illustrates a flowchart providing a process flow for implementing the disclosed techniques, according to an example embodiment.

With reference now made to FIG. 6, depicted therein is a flowchart 600 illustrating an example method for implementing the techniques of the present disclosure. Flowchart 600 begins in operation 605 in which fluid is pumped through tubing by compressing the tubing against an occlusion bed via rollers arranged on a rotor rotating about a shaft. Accordingly, operation 605 may be embodied as the operation of a peristaltic pump.

In operation 610, a lock on the rotor is unlocked. This unlocking unlocks a roller body of the rotor from a shaft body of the rotor. Accordingly, operation 610 may be embodied as the unlocking described above with reference to FIGS. 2A and 2B, 5A and 5B or 6.

Next, in operation 615, the roller body is translated along the shaft body such that the rollers no longer compress the tubing against the occlusion bed. Accordingly, operation 615 may be embodied as the translation of the roller body 106 described above with reference to FIGS. 2B and 2C or 5B and 5C.

While flowchart 600 illustrates the above-noted operations, the techniques disclosed herein may include more or fewer operations without deviating from the concepts of the present disclosure. For example, additional operations may include replacing the tubing with new tubing, translating the roller body back to an operating position, locking the roller body to the shaft body and/or pumping fluid through the new tubing. Operations that may be omitted include operation 605. For example, operations 610 and 615 may be performed during the initial configuration of a peristaltic pump, and may include additional operations, such as installing tubing in the pump, translating the roller body back to an operating position, locking the roller body to the shaft body and/or pumping fluid through the initially installed tubing.

In summary, provided for herein are techniques for providing peristaltic pump rotor/rollers with an integrated slide mechanism that allows for radial movement of the rotor, offsetting the rotor from the centralized pumping position. The slide mechanism locks into a central pumping position unless the release is activated. By activating the release, the offset rotor position allows a simpler, quicker, and/or safer tube set exchange for the user, particularly for dosing pump applications, among others.

Embodiments of the disclosed techniques may utilize a quick-release actuator to disengage portions of the rotor assembly that allow the disengaged portions of the rotor to slide radially relative to the motor shaft. This sliding creates an offset of the rollers from the occlusion bed. The offset roller position allows the tubing to be easily removed from the pump head. The offset also allows new tubing assembly connectors to be placed in the pump head positioning feature without manual elongation around a rotor/roller assembly rotating at, for example, 6 RPM. The offset rotor may automatically return to its nominal position, and as it does so it will elongate the tubing so it is recessed in the occlusion bed.

Accordingly, the techniques described herein relate to an apparatus including: a pump body, an occlusion bed; and a rotor including: a shaft body configured to engage a shaft which rotates the rotor; a roller body including one or more rollers and a track via which the roller body is slidably mounted to the shaft body; and a lock mechanism selectively positioned between a first position and a second position, wherein, in the first position, the lock mechanism locks the roller body at a first roller body position relative to the shaft body where the one or more rollers can compress tubing disposed in the apparatus against the occlusion bed with a first level of compression, and wherein, in the second position, the lock mechanism disengages the roller body so the roller body can slide along the track relative to the shaft body to a second roller body position configured to cause decreased or no compression of the tubing against the occlusion bed by the one or more rollers.

In some aspects, the techniques described herein relate to an apparatus, wherein the lock mechanism includes: one or more lever locks including an engagement surface; and an actuator configured to engage with the engagement surface and drive the one or more lever locks from the first position to the second position.

In some aspects, the techniques described herein relate to an apparatus, further including one or more biasing members providing a first force to the one or more lever locks to maintain the one or more lever locks in the first position, wherein actuating the actuator causes the actuator to engage with the engagement surface to provide a second force greater than the first force.

In some aspects, the techniques described herein relate to an apparatus, wherein the lock mechanism includes: one or more lever locks; and one or more locking cylinders including one or more notches, wherein the one or more lever locks engage respective notches of the one or more notches in the first position and rotation of the one or more locking cylinders disengages the one or more lever locks from the respective notches of the one or more notches in the second position.

In some aspects, the techniques described herein relate to an apparatus, wherein: the one or more lever locks include a first lever lock and a second lever lock, and the one or more locking cylinders include a first locking cylinder that includes a first notch and first teeth and a second locking cylinder that includes a second notch and second teeth engaged with the first teeth such that rotation of the first locking cylinder causes rotation of the second locking cylinder that disengages the first lever lock from the first notch and the second lever lock from the second notch.

In some aspects, the techniques described herein relate to an apparatus, wherein the shaft body is substantially configured in the shape of a first elongated hexagon.

In some aspects, the techniques described herein relate to an apparatus, wherein the track is substantially configured in the shape of a second elongated hexagon.

The techniques described herein also relate to a method including: pumping fluid through tubing by compressing the tubing against an occlusion bed via rollers arranged on a rotor rotating about a shaft; unlocking a lock on the rotor to unlock a roller body of the rotor from a shaft body of the rotor; and translating the roller body along the shaft body such that the rollers no longer compress the tubing against the occlusion bed.

In some aspects, the techniques described herein relate to a method, further including replacing the tubing with new tubing.

In some aspects, the techniques described herein relate to a method, wherein replacing the tubing includes replacing the tubing without elongating the new tubing.

In some aspects, the techniques described herein relate to a method, wherein a translation of the roller body along the shaft body so that the rollers no longer compress the tubing against the occlusion bed translates the roller body in a first direction and the method further includes: translating the roller body along the shaft body in a second direction, opposite the first direction, such that the rollers compress the new tubing against the occlusion bed.

In some aspects, the techniques described herein relate to a method, further including, subsequent to a translation in the second direction, locking the roller body to the shaft body.

In some aspects, the techniques described herein relate to a method, further including, subsequent to a translation in the second direction, pumping fluid through the new tubing.

The techniques described herein further relate to an apparatus including: a shaft body configured to engage a shaft; a roller body including one or more rollers and a track via which the roller body is slidably mounted to the shaft body; and a lock mechanism selectively positioned between a first position and a second position, wherein, in the first position, the lock mechanism engages the roller body to lock the roller body at a first roller body position relative to the shaft body where the one or more rollers can compress tubing against an occlusion bed with a first level of compression, and wherein, in the second position, the lock mechanism disengages the roller body so the roller body can slide along the track relative to the shaft body to a second roller body position configured to cause decreased or no compression of the tubing against the occlusion bed by the one or more rollers.

In some aspects, the techniques described herein relate to an apparatus, wherein the lock mechanism includes: one or more lever locks including an engagement surface; and an actuator configured to engage with the engagement surface and drive the one or more lever locks from the first position to the second position.

In some aspects, the techniques described herein relate to an apparatus, further including one or more biasing members providing a first force to the one or more lever locks to maintain the one or more lever locks in the first position, wherein actuating the actuator causes the actuator to engage with the engagement surface to provide a second force greater than the first force.

In some aspects, the techniques described herein relate to an apparatus, wherein the lock mechanism includes: one or more lever locks; and one or more locking cylinders including one or more notches, wherein the one or more lever locks engage respective notches of the one or more notches in the first position and rotation of the one or more locking cylinders disengages the one or more lever locks from the respective notches of the one or more notches in the second position.

In some aspects, the techniques described herein relate to an apparatus, wherein: the one or more lever locks include a first lever lock and a second lever lock, and the one or more locking cylinders include a first locking cylinder that includes a first notch and first teeth and a second locking cylinder that includes a second notch and second teeth engaged with the first teeth such that rotation of the first locking cylinder causes rotation of the second locking cylinder that disengages the first lever lock from the first notch and the second lever lock from the second notch.

In some aspects, the techniques described herein relate to an apparatus, wherein the shaft body is substantially configured in the shape of a first elongated hexagon.

In some aspects, the techniques described herein relate to an apparatus, wherein the track is substantially configured in the shape of a second elongated hexagon.

While the techniques presented herein have been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. For example, the peristaltic pump, the rotor, the shaft body, and components thereof herein may be modified to be of any shape, unless otherwise specified.

In addition, various features from one of the embodiments may be incorporated into another of the embodiments. That is, it is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Accordingly, it is appropriate that the appended claims be construed broadly and in a manner consistent with the scope of the disclosure as set forth in the following claims.

It is also to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention. Additionally, it is also to be understood that the peristaltic pump, the rotor, the shaft body, and/or any components described herein, or portions thereof, may be fabricated from any suitable material or combination of materials, such as, but not limited to, plastics, metals (e.g., nickel, copper, bronze, aluminum, steel, etc.), metal alloys, elastomeric materials, etc., as well as derivatives thereof, and combinations thereof, unless otherwise specified. In addition, it is further to be understood that the steps of the methods described herein may be performed in any order or in any suitable manner.

Still further, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about", "around", "generally", and "substantially."

Finally, for the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

What is claimed is:

1. An apparatus comprising:

a pump body, an occlusion bed; and a rotor comprising:

a shaft body configured to engage a shaft which rotates the rotor;

a roller body comprising one or more rollers and a track via which the roller body is slidably mounted to the shaft body; and a lock comprising one or more lever locks, the one or more lever locks selectively positioned between a first position and a second position, wherein, in the first position, the one or more lever locks lock the roller body at a first roller body position relative to the shaft body where the one or more rollers can compress tubing disposed in the apparatus against the occlusion bed with a first level of compression, and wherein, in the second position, the one or more lever locks disengage the roller body so the roller body can slide along the track relative to the shaft body to a second roller body position configured to cause decreased or no compression of the tubing against the occlusion bed by the one or more rollers.

2. The apparatus of claim 1, wherein:

the one or more lever locks comprise an engagement surface; and the lock further comprises an actuator configured to engage with the engagement surface and drive the one or more lever locks from the first position to the second position.

3. The apparatus of claim 2, further comprising one or more biasing members providing a first force to the one or more lever locks to maintain the one or more lever locks in the first position, wherein actuating the actuator causes the actuator to engage with the engagement surface to provide a second force greater than the first force.

4. The apparatus of claim 1, wherein the lock comprises:

one or more locking cylinders comprising one or more notches, wherein the one or more lever locks engage respective notches of the one or more notches in the first position and rotation of the one or more locking cylinders disengages the one or more lever locks from the respective notches of the one or more notches in the second position.

5. The apparatus of claim 4, wherein:

the one or more lever locks comprise a first lever lock and a second lever lock, and the one or more locking cylinders comprise a first locking cylinder that includes a first notch and first teeth and a second locking cylinder that includes a second notch and second teeth engaged with the first teeth such that rotation of the first locking cylinder causes rotation of the second locking cylinder that disengages the first lever lock from the first notch and the second lever lock from the second notch.

6. An apparatus comprising:

a pump body, an occlusion bed; and a rotor comprising:

a shaft body configured to engage a shaft which rotates the rotor and is substantially configured in the shape of a first elongated hexagon;

a roller body comprising one or more rollers and a track via which the roller body is slidably mounted to the shaft body; and a lock selectively positioned between a first position and a second position, wherein, in the first position, the lock locks the roller body at a first roller body position relative to the shaft body where the one or more rollers can compress tubing disposed in the apparatus against the occlusion bed with a first level of compression, and wherein, in the second position, the lock disengages the roller body so the roller body can slide along the track relative to the shaft body to a second roller body position configured to cause decreased or no compression of the tubing against the occlusion bed by the one or more rollers.

7. The apparatus of claim 6, wherein the track is substantially configured in the shape of a second elongated hexagon.

8. The apparatus of claim 1, wherein the pump body comprises a surface against which the one or more rollers engage when the roller body is in the second roller body position such that rotation of the one or more rollers along the surface translates the roller body from the second roller body position to the first roller body position.

9. A method comprising:

arranging a roller body of a rotor at a first roller body position such that one or more rollers of the roller body compress tubing against an occlusion bed;

pumping fluid through the tubing by rotating the roller body about a shaft;

unlocking a lock on the rotor to unlock the roller body of the rotor from a shaft body of the rotor by translating one or more lever locks of the lock from a first lever position to a second lever position; and translating the roller body along the shaft body to a second roller body position configured to caused decreased or no compression of the tubing against the occlusion bed.

10. The method of claim 9, further comprising replacing the tubing with new tubing.

11. The method of claim 10, wherein replacing the tubing comprises replacing the tubing without elongating the new tubing.

12. The method of claim 10, wherein translating the roller body along the shaft body to the second roller body position translates the roller body in a first direction and the method further comprises:

translating the roller body along the shaft body in a second direction, opposite the first direction, such that the roller body returns to the first roller body position.

13. The method of claim 12, further comprising, subsequent to a translation in the second direction, locking the roller body to the shaft body.

14. The method of claim 12, further comprising, subsequent to a translation in the second direction, pumping fluid through the new tubing.

15. An apparatus comprising:

a shaft body configured to engage a shaft;

a roller body comprising one or more rollers and a track via which the roller body is slidably mounted to the shaft body; and a lock comprising one or more lever locks, the one or more lever locks selectively positioned between a first position and a second position, wherein, in the first position, the one or more lever locks engage the roller body to lock the roller body at a first roller body position relative to the shaft body where the one or more rollers can compress tubing against an occlusion bed with a first level of compression, and wherein, in the second position, the one or more lever locks disengage the roller body so the roller body can slide along the track relative to the shaft body to a second roller body position configured to cause decreased or no compression of the tubing against the occlusion bed by the one or more rollers.

16. The apparatus of claim 15, wherein the lock comprises:

the one or more lever locks comprise an engagement surface; and an actuator configured to engage with the engagement surface and drive the one or more lever locks from the first position to the second position.

17. The apparatus of claim 16, further comprising one or more biasing members providing a first force to the one or more lever locks to maintain the one or more lever locks in the first position, wherein actuating the actuator causes the actuator to engage with the engagement surface to provide a second force greater than the first force.

18. The apparatus of claim 15, wherein the lock comprises:

one or more locking cylinders comprising one or more notches, wherein the one or more lever locks engage respective notches of the one or more notches in the first position and rotation of the one or more locking cylinders disengages the one or more lever locks from the respective notches of the one or more notches in the second position.

19. The apparatus of claim 18, wherein:

the one or more lever locks comprise a first lever lock and a second lever lock, and the one or more locking cylinders comprise a first locking cylinder that includes a first notch and first teeth and a second locking cylinder that includes a second notch and second teeth engaged with the first teeth such that rotation of the first locking cylinder causes rotation of the second locking cylinder that disengages the first lever lock from the first notch and the second lever lock from the second notch.

20. The apparatus of claim 15, wherein the shaft body is substantially configured in the shape of a first elongated hexagon.

* * * * *